United States Patent [19]

Felix

[11] Patent Number: 4,730,762

[45] Date of Patent: Mar. 15, 1988

[54] PROCESS AND EQUIPMENT FOR MANUFACTURING INDIVIDUAL STACKS CONSISTING OF A LENGTH OF MATERIAL FOLDED IN ZIG ZAG FORM

[75] Inventor: Willi Felix, Strengelbach, Switzerland

[73] Assignee: Jos. Hunkeler Ltd., Wikon, Switzerland

[21] Appl. No.: 52,208

[22] Filed: May 15, 1987

Related U.S. Application Data

[63] Continuation of Ser. No. 817,473, Jan. 9, 1986, abandoned.

[30] Foreign Application Priority Data

Jan. 11, 1985 [DE] Fed. Rep. of Germany ..... 3500766

[51] Int. Cl.[4] ..... B26F 3/02

[52] U.S. Cl. ..... 225/4; 83/92; 225/100; 225/106; 270/39

[58] Field of Search ..... 225/106, 100, 1, 4; 83/92, 90; 270/39, 30

[56] References Cited

U.S. PATENT DOCUMENTS

| | | | |
|---|---|---|---|
| 2,411,075 | 11/1946 | Wyrick | 270/39 X |
| 3,724,838 | 4/1973 | Orlovsky | 270/39 X |
| 3,913,904 | 10/1975 | Occhetti | 270/39 X |
| 3,937,452 | 2/1976 | Gäth | 270/39 |
| 4,118,022 | 10/1978 | Rayfield et al. | 225/100 X |
| 4,134,559 | 1/1979 | Dyllus et al. | 242/78.1 |
| 4,261,497 | 4/1981 | Roetter | 225/106 X |
| 4,296,684 | 10/1981 | Wangermann | 100/292 |
| 4,573,670 | 3/1986 | Felix | 270/39 |

FOREIGN PATENT DOCUMENTS 2704502 8/1978 Fed. Rep. of Germany .

*Primary Examiner*—Frank T. Yost

*Attorney, Agent, or Firm*—Davis Hoxie Faithfull and Hapgood

[57] ABSTRACT

Method and apparatus for producing individual stacks of zigzag-folded material from a continuously fed length of material containing cross perforations. A target cross perforation is sensed and halted ahead of the stack being formed. By gripping the material downstream of the target point and reversing the direction of travel of the material, separation at the target point is achieved, after which the completed stack is removed automatically. Continuous feed of material even during stack separation and removal is maintained by provision of an intermediate buffer storage which is drawn down as each stack is being formed.

25 Claims, 4 Drawing Figures

Figures 1, 2:
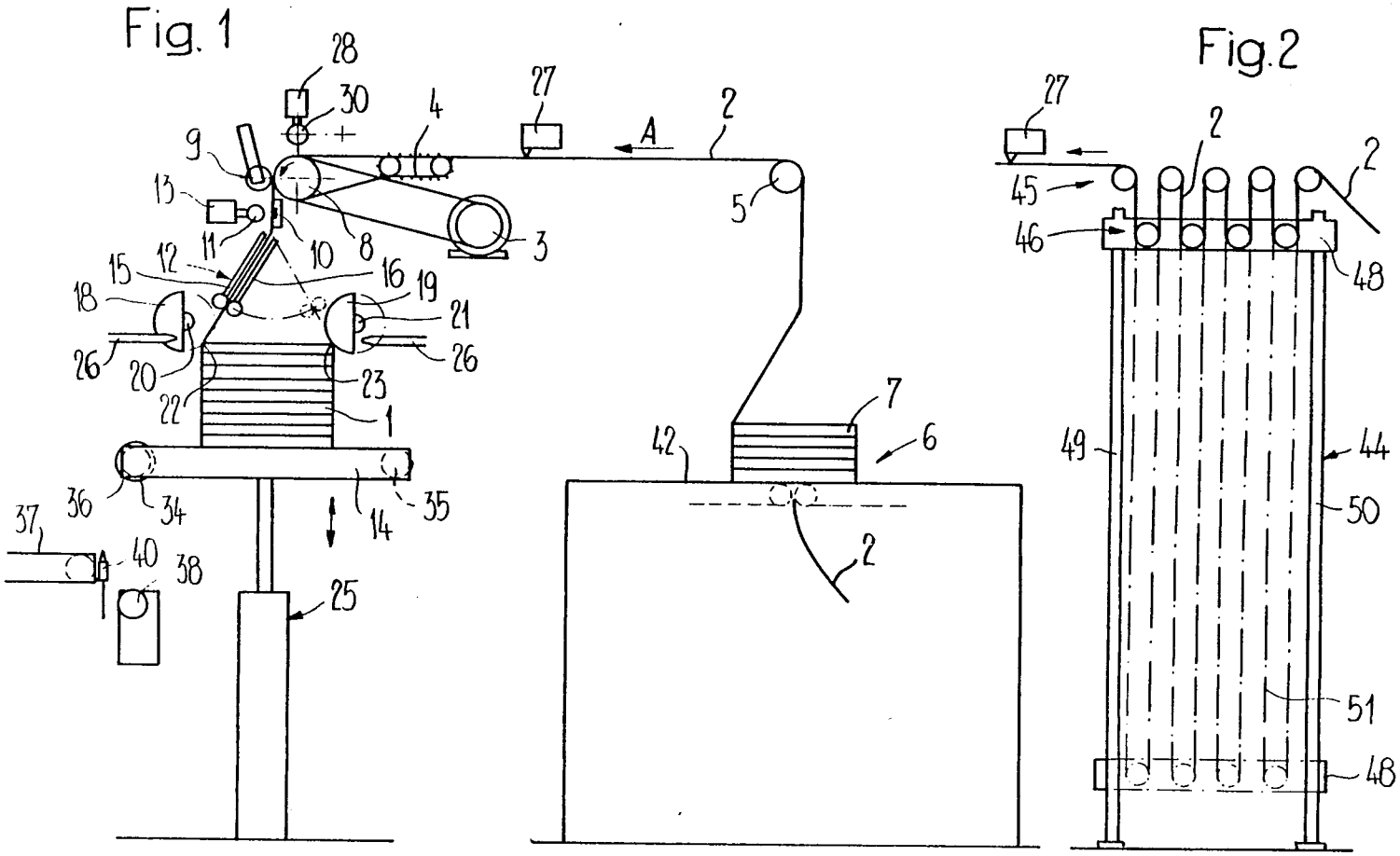

PROCESS AND EQUIPMENT FOR MANUFACTURING INDIVIDUAL STACKS CONSISTING OF A LENGTH OF MATERIAL FOLDED IN ZIG ZAG FORM

This is a continuation of co-pending application Ser. No. 817,473 filed on Jan. 9, 1986, now abandoned.

The invention concerns a process and a device for manufacturing individual stacks consisting of a length of material folded in zigzag form.

A process and a device of this type are known from European Patent Application EP-OS No. 0 057 463, in which the length of material on both sides of the target separation line is gripped between two pairs of rollers. The pair of rollers closer to the stack is then moved in the direction of conveyance of the length of material, the consequence being a tearing of the material along the target separation line between the pairs of spools. The last section of the length of material folded into a stack is gripped by the pair of spools activated and is accelerated vis-a-vis the rest of the length of material.

In this known solution, a separation device is needed that is relatively expensive to build, and which is completely separate from the feed device. In addition, separation is done while the length of material is being moved forward. This imposes certain limits on an increase in processing speed. From patent DE-OS No. 28 51 894 a separating device is known in which two drive rollers are positioned close to each other and are driven in the same direction and at the same speed in order to move the material forward. To separate the material along a perforated line the rear pair of rollers as viewed in the direction of conveyance is halted while the other pair of rollers continue to move the material forward. Because of the double function of one pair of rollers (advancing and gripping), this device is not very suitable for applications in which the material is moved at high speed and generally results in a separation, because of requirement it imposes for an often rapid acceleration of the said pair of spools after each separation. In addition, even during the forward movement this pair of spools must exert a certain pressure on the length of material so that they will be able to grip the material sufficiently when the material is in stationary position. In the case of thin materials, this gives rise to difficulties and can lead to damages in the material.

It is an object of the present invention to create a process and a device that make it possible even at high work speeds, with measures that from a construction point of view are simple, to obtain a perfect stack formation along with safe separation of the material along target separation lines.

To separate the material, the last section of the material segment to be stacked is gripped by the gripping arrangement, while the material is moved backward. Thus the position of the separation point does not change during the separation, that is, the back edge of the material segment to be stacked has a precisely determined position, which facilitates the subsequent controlled zigzag folding and separating of the stack. During the separating of the material, after a stack is shaped the stack formation process is interrupted until the prepared stack has been moved away and the stack formation device is ready to form a new stack. To avoid the need to interrupt the feeding of the material despite this interruption in the stack formation, a portion of the continuously flowing material is preferably stored temporarily in a buffer storage, which after separation of the material can be returned to its standard level by means of a brief increase in working speed. For the reverse movement of the material during the separation process, components of the feed mechanism for the material can be used, which simplifies the construction.

Figure 4:
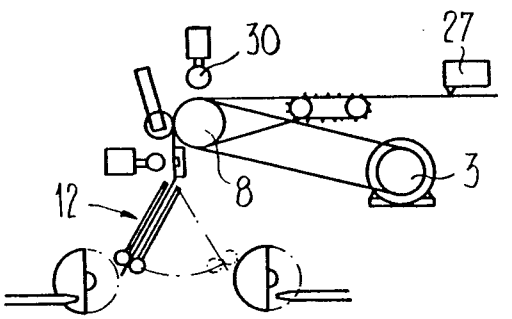
Figure 3:
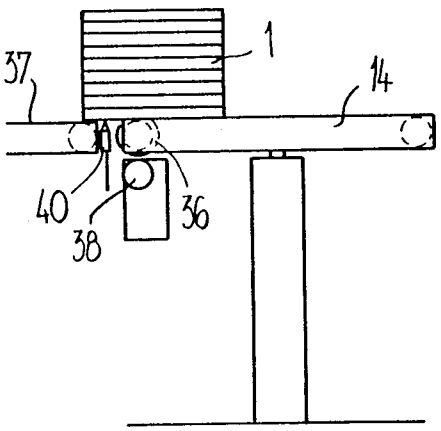
Figure 3:
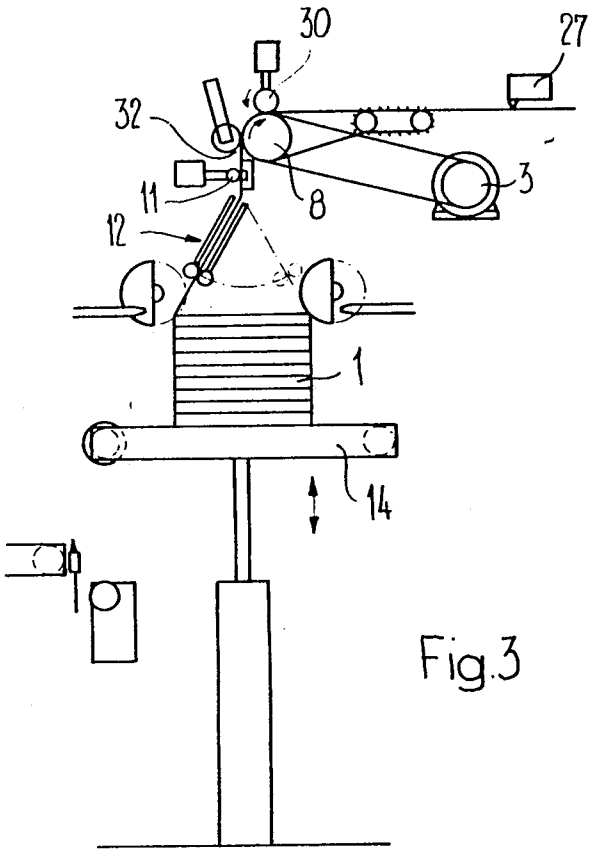

The invention will now be described in greater detail by means of drawings showing:

FIG. 1 a schematic representation of a side view of a device for implementing the process;

FIG. 2 a schematic representation of an appropriate intermediate storage memory for the device in FIG. 1;

FIG. 3 a part of the device according to FIG. 1 in a work phase, shortly after separation of the material; and FIG. 4 a part of the device according to FIG. 1 at the time of interruption of the stack formation and the removal of the separated stack.

FIG. 1 shows the device for implementing the process in a continuous working process during the formation of a stack 1 from a continuously supplied length of material 2 by means of zigzag folding and bending. The length of material 2, for example paper for computer printers, has perforation lines along its edges into which lines the teeth of a conveyor component 4 driven by motor 3 penetrate. In addition, the length of material 2 has, at regular intervals corresponding to the width of the stack 1 to be formed, crossways perforation lines along which the folding is done during the formation of the stack, and along which the material is pre-folded in a pre-determined fold direction by a continuous folding device 6. By means of the pre-folding along the crossways perforation lines, folding during the production of the stack 1 is facilitated and in addition the precise and easy separation of the length of material along such a perforation line is ensured. A folding device suitable for use in the equipment according to the invention is described in greater detail in DE-OS No. 33 44 260.

By means of the motor-driven conveyor component 4, the material is drawn away by means of a reversing roller 5 from an intermediate stack 7 that forms a buffer for the work process and is fed to a conveyor roller 8 that is also driven by drive 3. At this point, by means of at least one feed roller 9 operating along with it, there is a vertical diverting of the material 2 downward, past a clamping strip 10, to a swing guide 12, which makes a swinging movement in known manner and thereby folds the material in zigzag manner on the elevating platform 14 to form stack 1. Facing said clamping strip 10, which is stationary, there is a movable pinching strip 11, which can be pressed by means of a guided shearing drive 13 against the stationary clamping strip 10 so that the material can be held in position. The swing guide 12 has two guide plates 15, 16 that run parallel to each other, between which the material is guided. On each side of the stack 1 to be created, in the area of the stack and fold edges, there are semi-circular pressure components 18, 19, which are attached to a shaft 20, 21 rotating synchronously with the unshown swing drive of the swing guide. These pressure components 18, 19 alternatingly press fold edges 22, 23 on the stack when the material is being folded, so that during the alternating, i.e. zigzagging, folding of the material high operating speeds can be achieved. The movement guidances of the folded material deposited on platform 14 is supported at the start of the stack formation by one of the blast nozzles 24, 26, depending on the direction which the folding begins.

As the height of the stack 1 grows, an elevating drive 25 lowers elevating platform 14 automatically. The separation of the completed stack 1 from the following length of material 2 is done by means of a marking in material length 2, i.e. a printed or perforated marking, which is scanned by a signal transmitter 27 installed on the guide track. The signal given by the signal transmitter triggers a sequence of pre-programmed work steps. First, drive 3 for conveyor component 4 and conveyor roller 8, as well as the drive for the swing control 12 and pressure components 18, 19 are switched off, but with a lag, until the pre-folded perforated line along which the separation is to be made has passed clamping strip 10. Lastly, a shear drive 28 moves a conveyor roller 30, driving in the opposite direction, in contact with the direction of travel of material 2, in the contact area of conveyor roller 8, so that the material is reversed. After the pre-determined separation point or crossways perforation line has again passed clamping strip 10, by means of the pressure movement of pinching strip 11 the clamping strip 10 is activated and grips the material 2, so that it tears at the pre-determined point 32. FIG. 3 shows the moment shortly after the separation with contact position of the conveyor roller 30 and the pinching strip 11.

Lastly, these contact positions are again released and the material is again conveyed forward, until the beginning of the new segment or the first sheet for a new stack is approximately above the swing guide 12. At that moment the conveyance halts again, in order to carry away the separated stack by means of the lowering of the elevating platform 14. The elevating platform is constructed as a conveyor platform, having endless belts led over rollers 34, 35. One of the rollers has a toothed wheel 36, which after the lowering of the elevating platform to the level of a stationary second conveyor belt 37 makes contact with a second driven toothed wheel 38, so that the conveyor belt transports and accordingly the stack is carried away from the elevating platform 14. A second signal transmitter 40 position at the start of the second conveyor signals the transfer of stack 1 to the second conveyor belt to the drive control of elevating platform 14, so as to return the elevating platform 14 again to its upper starting position. After this position is reached, the conveyance of the material and the elements 12, 18, 19 24, 26 for stack formation are again activated, until a new marking passes the signal transmitter 27 and the stack forming process described above is repeated.

The pre-activated continuous folding device 6 does not have to be switched off during the halt in conveyance of material 2, since a stack is formed here as well. This intermediate stack 7 acts as a buffer for the continuous conveyance of the material, starting from a roll of material, not shown. Since the folding device 6 forms the stack from bottom to top, and this stack is positioned on a platform 42, a large buffer volume exists because of the relatively large space above platform 42. After the reactivation of the conveyance the intermediate buffer stack 7 that has in the meantime been formed is reduced by means of an initially increased operating speed of conveyance and the formation of stack 1. Of course appropriate control devices for this purpose exist that also regulate the height of the intermediate stack 7.

In another embodiment a buffering of the work flow can also be achieved by means of an intermediate storage method of a different type, instead of by formation of a stack, for example as shown in FIG. 2. This intermediate storage 44 has two rows 45, 46 of reversing rollers over which the material is conveyed in the form of sequential loops. The upper row 45 of reversing rollers has stationary hinge pins, while the reversing rollers of the bottom row 46 are housed in a frame 48, which can be moved up and down on vertical guides 49, 50, for example under their own weight, depending on the necessary lengths of material 2 stored in the intermediate storage 44. Broken lines 51 indicate the inventory of large stored lengths of material 2. When this intermediate storage 44 is used, pre-folding is done on the crossways perforation lines of the material in a predetermined direction, or starting with a pre-folded strip of material in rolls or stacks.

An alternate mode of operation is to control the stopping of material 2 such that the target separation line lies between strips 10, 11 and rollers 8, 9.

If the material is so halted prior to separation by appropriate control, so that the perforation line along which the separation is to be made halts between strips 10, 11 and roller pairs 8, 9, the pair of strips can immediately go into operation to hold the material, and the brief reversal, by means of the conveyor rollers then placed under pressure, causes the immediate separation along this perforation line.

I claim:

1. Process for the production of individual zigzag folded stacks from a continuous length of material containing sections defined by cross perforations, comprising the steps of:

a. continuously feeding the length of material to a buffer;

b. withdrawing from the buffer a quantity of said length of material sufficient to form an individual stack;

c. feeding said quantity to a zigzag folder and stacker;

d. folding and stacking said quantity;

e. separating said quantity from the remainder of said length of material at a selected cross perforation intended to be the end of said quantity by simultaneously (i) gripping the section of said quantity preceding said selected cross perforation before it is folded, and (ii) driving in an upstream direction the portion of the remainder of said length of material following said selected cross perforation;

f. releasing the last section of said quantity to complete said individual stack;

g. removing the finished stack from the zigzag folder and stacker; and h. resuming forward flow from the buffer of a next quantity of said length of material sufficient to form a next individual stack according to steps c through g.

2. Process according to claim 1 wherein said buffer comprises a zigzag-folded intermediate stack of said material, further comprising the steps of a. feeding material to said intermediate stack from below, and b. withdrawing material from the top of said intermediate stack.

3. Process according to claim 2 comprising the additional step of temporarily accelerating the forward flow of material from the buffer upon resumption of said forward flow in order to maintain the size of the intermediate stack within predetermined limits.

4. Process according to claim 1 wherein said buffer comprises at least one expandable loop of material.

5. Process according to claim 1 comprising the additional steps of a. sensing the location of the selected cross perforation intended to be the end of the quantity of material in said stack, and b. initiating the gripping and reversing steps as a consequence of sensing said location.

6. Process according to claim 5 comprising the additional steps of a. feeding the selected cross perforation intended to be the end of the quantity of material in said stack past a gripping means, b. initiating the step of driving in an upstream direction, and c. initiating the step of gripping the last section of material after the selected cross perforation has traveled back past said gripping means.

7. Process according to claim 6 wherein said buffer comprises a zigzag-folded intermediate stack of said material, further comprising the steps of a. feeding material to said intermediate stack from below, and b. withdrawing material from the top of said intermediate stack.

8. Process according to claim 6 wherein the step of driving in an upstream direction the portion of the remainder of said length of material following said selected cross perforation comprises driving in an upstream direction the section of the remainder of said length of material immediately following said selected cross perforation.

9. Process according to claim 8 wherein said length of material also contains edge perforations.

10. Process according to claim 1 wherein said length of material also contains edge perforations.

11. Process according to claim 1 wherein the step of driving in an upstream direction the portion of the remainder of said length of material following said selected cross perforation comprises driving in an upstream direction the section of the remainder of said length of material immediately following said selected cross perforation.

12. Process according to claim 1 wherein initiation of step h precedes completion of step g.

13. Apparatus for the production of individual zigzag folded stacks from a continuous length of material containing sections defined by cross perforations, comprising:

a. zigzag folding and stacking means for preparing stacks folded at said cross perforations;

b. forward feeding means for feeding said length of material to said folding and stacking means;

c. conveying means for removing finished stacks from said folding and stacking means;

d. gripping means positioned upstream of said folding and stacking means for gripping and holding fast said length of material;

e. reverse driving means, located upstream of said gripping means, for driving said length of material in an upstream direction;

f. control means for i. energizing said forward feeding means and said zigzag folding and stacking means to produce a first individual stack, ii. deenergizing said forward feeding means and said zigzag folding and stacking means after a selected cross perforation intended to be the end of a first quantity of said length of material in said first individual stack has passed the reverse feeding means;

iii. energizing said reverse driving means;

iv. energizing said gripping means to engage the length of material when said selected cross perforation is between the gripping means and the reverse driving means;

v. deenergizing said reverse driving means and said gripping means after a short interval, sufficient to separate said length of material at said selected cross perforation, with both energized; and vi. reenergizing said forward feeding means and said folding and stacking means.

14. Apparatus according to claim 13 wherein said reverse driving means is located upstream of said gripping means by less than twice the length of one of said sections.

15. Apparatus according to claim 14 wherein said length of material also contains edge perforations.

16. Apparatus according to claim 13 wherein said forward feeding means and said reverse feeding means comprise a common reversible drive means.

17. Apparatus according to claim 13 comprising sensing and transmitting means for sensing the location of said selected cross perforation and for transmitting that information to said control means.

18. Apparatus according to claim 13 wherein said folding and stacking means comprises a swing guide.

19. Apparatus according to claim 13 wherein said control means additionally comprises means for energizing said conveying means after said gripping means are deenergized to remove said first individual stack from the folding and stacking means before restarting said forward feeding means.

20. Apparatus according to claim 13 wherein said folding and stacking means comprises an elevating platform for receiving folded material, said platform comprising conveying means for removing finished stacks from said folding and stacking means.

21. Apparatus according to claim 20 wherein said conveying means for removing finished stacks from said folding and stacking means comprises at least one freely rotatable conveyor belt on said elevating platform and drive means engageable with said freely rotatable conveyor for driving said conveyor to remove finished stacks from said elevating platform.

22. Apparatus according to claim 21 comprising sensing and transmitting means for sensing passage of a finished stack from the elevating platform and for transmitting that information to said control means, wherein said control means further includes means to return the elevating platform to its starting position in response to a signal from said sensing and transmitting means.

23. Apparatus according to claim 13 additionally comprising an intermediate storage buffer, located upstream of said forward feeding means, for temporarily storing material continuously input to said buffer when said forward feeding means is deenergized.

24. Apparatus according to claim 23, wherein said intermediate storage buffer comprises a bottom-fed zigzag folder-stacker.

25. Apparatus according to claim 24, wherein said intermediate storage buffer comprises expandable loop-forming apparatus.

* * * * *